US005186874A

United States Patent [19]

McLaughlin

[11] Patent Number: 5,186,874

[45] Date of Patent: Feb. 16, 1993

[54] METHOD FOR CASTING STAIRS WITHIN POOLS

[76] Inventor: Raymond McLaughlin, Rogers Rd., Far Hills, N.J. 07931

[21] Appl. No.: 523,740

[22] Filed: May 15, 1990

[51] Int. Cl.[5] ..... B28B 7/22; E04B 1/16; E04G 13/06; E04H 4/00

[52] U.S. Cl. ..... 264/35; 4/506; 52/169.7; 52/183; 52/187; 52/188; 249/14; 249/19; 249/159; 249/171; 249/DIG. 3; 264/32; 264/336

[58] Field of Search ..... 264/31-35, 264/336; 4/506, 488; 249/DIG. 3, 14, 19, 2-8, 155, 159, 170, 171; 52/169.7, 742, 182-184, 187-190

[56] References Cited

U.S. PATENT DOCUMENTS

| | | | |
|---|---|---|---|
| 1,124,327 | 1/1915 | Park | 249/14 |
| 1,770,518 | 7/1930 | Harrold | 249/5 |
| 2,610,380 | 9/1952 | Pollman | 249/14 |
| 2,626,444 | 1/1953 | Wolf et al. | 249/8 |
| 3,157,098 | 11/1964 | Mason | 249/8 |
| 3,284,042 | 11/1966 | Ingalise | 249/14 |
| 3,355,897 | 12/1967 | Mullen, Jr. | 264/32 |
| 3,385,552 | 5/1968 | Von Drasek et al. | 249/4 |
| 4,406,439 | 9/1983 | Garter | 264/32 X |
| 4,444,374 | 4/1984 | Gramstad | 249/14 |
| 4,599,835 | 7/1986 | Rinke | 52/169.7 |
| 4,625,343 | 12/1986 | Bumgarner, Sr. | 249/DIG. 3 |

FOREIGN PATENT DOCUMENTS

| | | | |
|---|---|---|---|
| 138384 | 7/1948 | Australia | 249/8 |

*Primary Examiner*—Karen Aftergut
*Attorney, Agent, or Firm*—Fish & Richardson

[57] ABSTRACT

A method of constructing arcuate cement stairs in a pool includes (a) attaching a first arcuate form having a first form radius to the wall of the pool; (b) attaching a second arcuate form having a second form radius smaller than the first form radius to the wall in a plane above the first arcuate form; (c) attaching to the wall of the pool, inwardly of the first form, a first arcuate support band having a radius generally corresponding to the first form radius, the first band remaining in place when the first form is removed, and attaching to the wall of the pool, inwardly of the second form, a second arcuate support band having a radius generally corresponding to the second form radius, the second band remaining in place when the second form is removed; (d) pouring a curable cement-containing material into the space between the forms and the wall to form stairs; and (e) removing the arcuate forms to provide the stairs.

5 Claims, 4 Drawing Sheets

FIG.3
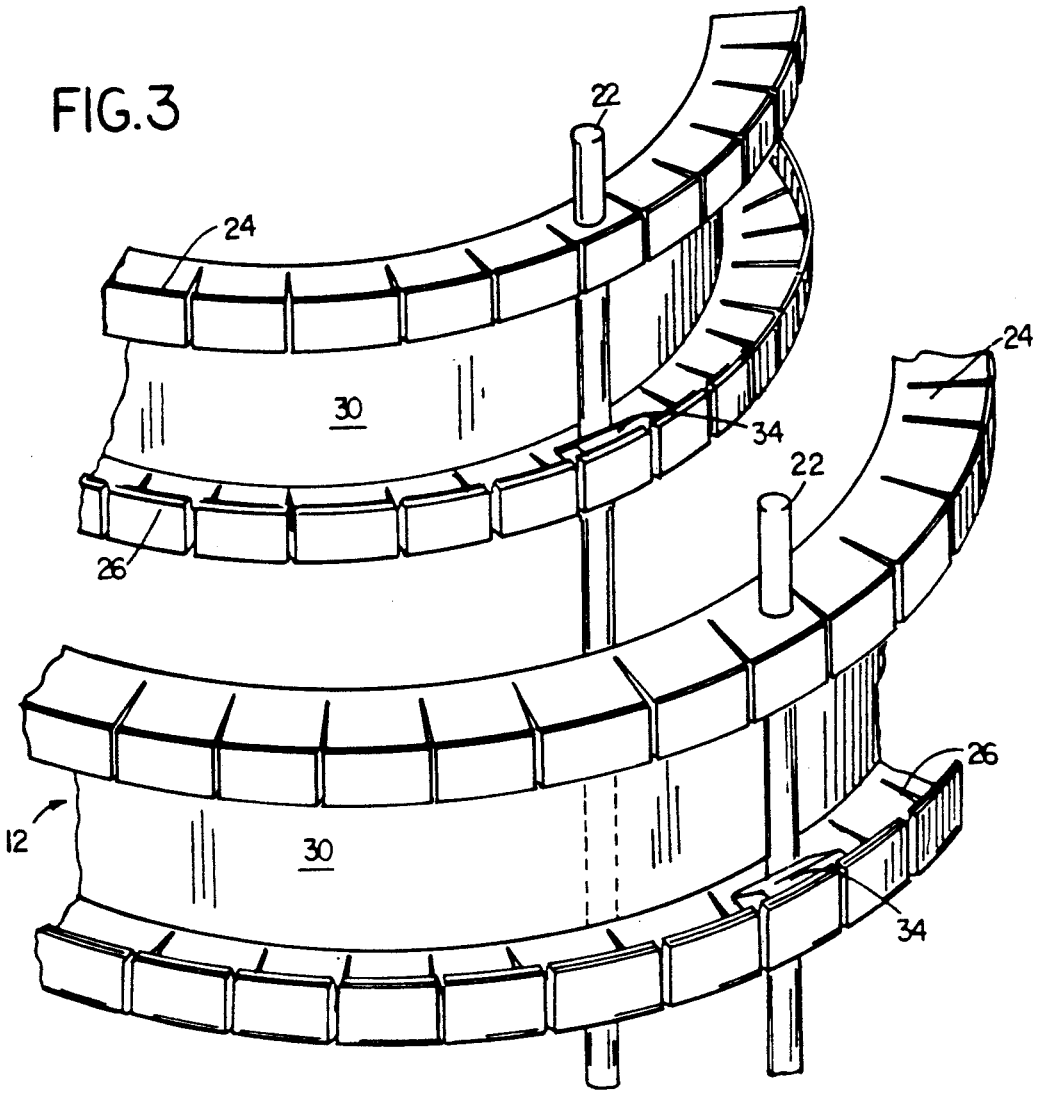
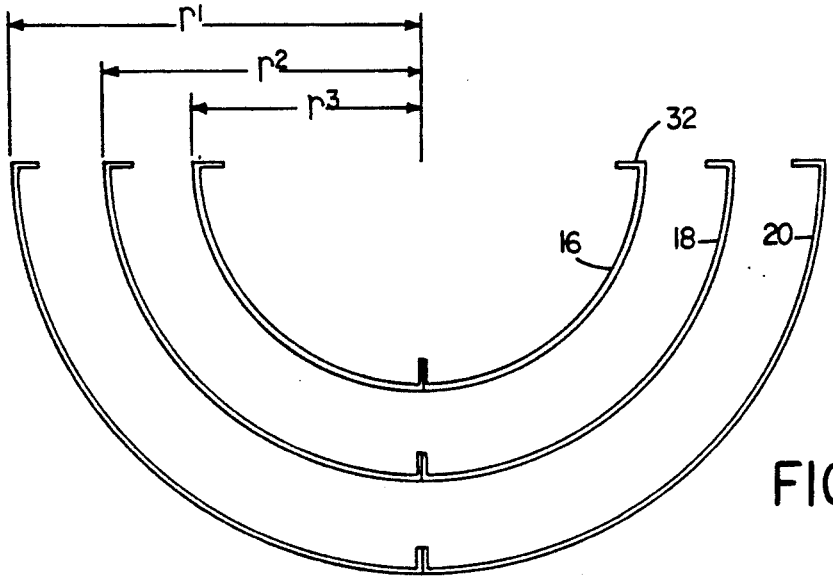
FIG.4

METHOD FOR CASTING STAIRS WITHIN POOLS

BACKGROUND OF THE INVENTION

The invention relates to pool stairs.

Swimming pools include a set of stairs to allow swimmers to get out of the pool. The stairs typically are made of either fiberglass, plastic, or steel, and are typically installed into the pool at the time of construction. There are also plastic or fiberglass stairs which can be inserted into the pool sometime after the pool is completed.

SUMMARY OF THE INVENTION

In general, the invention features, in one aspect, a system for the construction of arcuate concrete stairs in swimming pools. The system includes a first generally inflexible arcuate form having a first form radius defining an inner surface of the form, a second generally inflexible arcuate form having a second, smaller form radius defining an inner surface of the second form; and means for positioning the second form in a plane above a plane of the first form. By positioning the second form in a plane above a plane of the first form, it is meant that the general plane defining the top of the first form (in use) is beneath the corresponding plane of the second form (in use).

Preferably the system also includes a first arcuate support band having a radius generally the same as the first form radius and adapted for deployment inwardly of the first form; and a second arcuate support band having a radius generally the same as the second form radius and adapted for deployment inwardly of the second form. The forms can be removed while leaving the bands in place.

In preferred embodiments, the means for positioning are attachment elements at the ends of the second form, and each form and band defines an arc of 90°. For constructing stairs on a flat wall of a pool, the forms and bands each define an arc of 180°. The preferred forms and bands defining an arc of 180° are made by combining two forms, or bands, defining an arc of 90°, which conveniently allows one set of multiple forms and bands to be used to form corner stairs (90° arc), flat wall stairs (180° arc), or even circular stairs (360°).

The system provides an inexpensive, straightforward, and convenient method of constructing a set of arced stairs in pools in one step. Importantly, when the bands are present to support the stairs, the forms can be removed quickly after the stairs are poured. The forms can be reused time and time again, particularly since the forms are generally inflexible (i.e., are not readily bent from their pre-determined, manufactured shape).

DESCRIPTION OF THE PREFERRED EMBODIMENT

DRAWINGS

FIG. 3 is a close-up view of a portion of the system in FIG. 1.

FIG. 4 is a top view of three sets of bands of different radii as used to construct a set of stairs having an arc of 180°.

STRUCTURE

Figure 1:
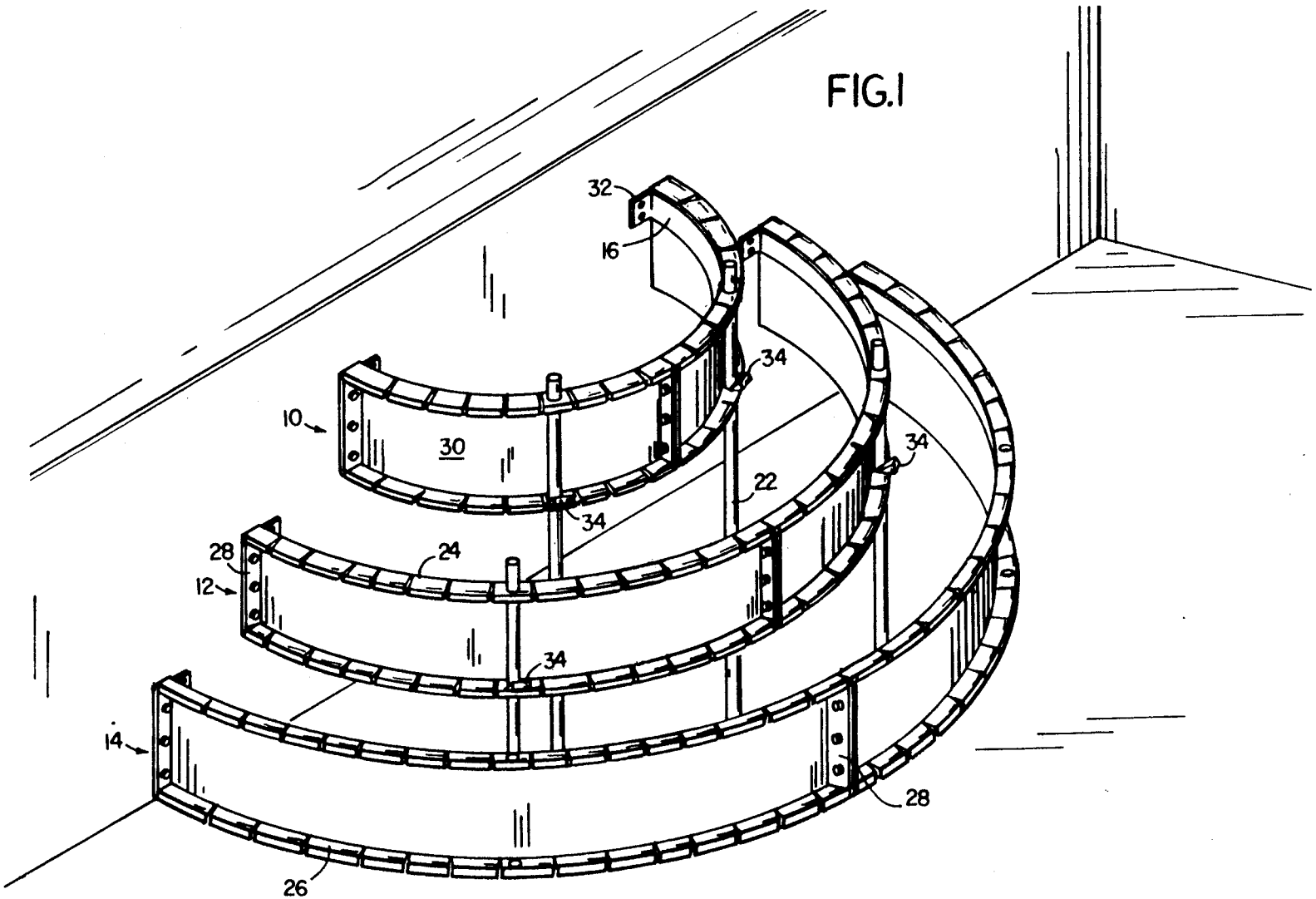
FIG. 1 is a perspective view of the preferred system of the invention in use.
Figure 2:
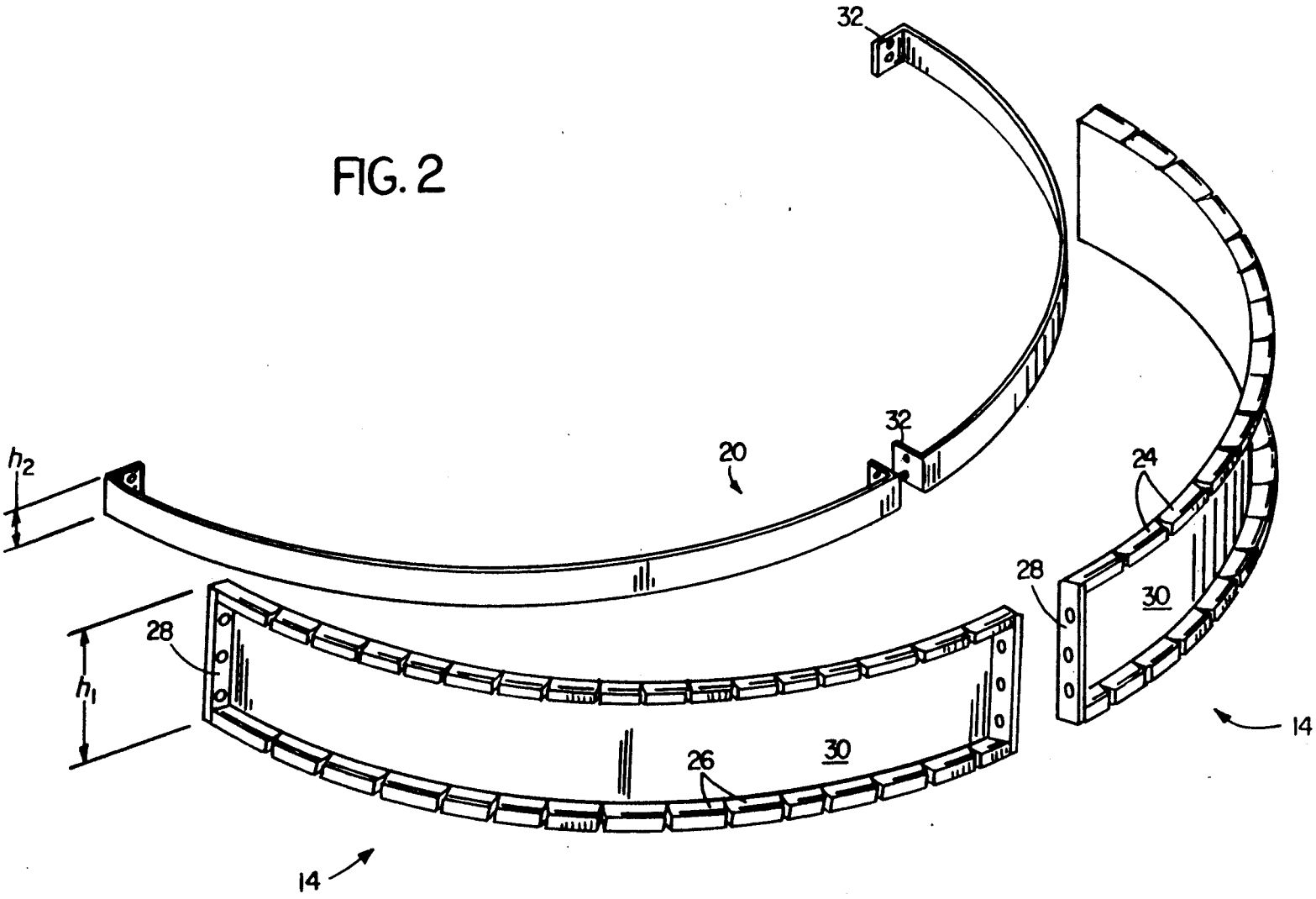
FIG. 2 is a perspective view of the preferred forms and support bands.

Referring to FIGS. 1-3, the preferred system includes a set of forms 10, 12, and 14; a corresponding set of arcuate bands 16, 18, and 20; and steel leveling rods 22.

The forms are made of 14 gauge galvanized steel and have a height ($h_1$) of 11 inches. The forms each include upper flanges 24 and lower flanges 26. At least one corresponding upper and lower flange of each form has a drilled hole through which the leveling rod can pass. The ends of each form have elements 28, which are adapted for attachment to either the pool wall or another form. The forms also include a flat inner surface 30. Forms 10, 12, and 14 define areas having radii, respectively, of 26, 36, and 46 inches; and have lengths, respectively, of 40¾, 56 1/16, and 72¼inches.

The bands are also made of 14 gauge galvanized steel and have a height ($h_2$) of three inches. The bands include end elements 32 adapted for attachment to either the pool wall or another band. Each band is designed so that in use it will rest flat against inner surface 30 of the corresponding form. The bands have approximately the same length as the corresponding forms, and define areas having approximately the same radii, since in use a band rests against inner surface 30 of its corresponding form; for practical purposes the radii of a form and its corresponding band are generally the same.

USE

The preferred system can be designed to produce concrete stairs of any angle. The most common uses for the forms in swimming pools are to produce stairs in the corner of a pool (90° or 135° angle); on a straight wall of a pool (180° angle); or to form circular stairs.

To construct a set of 180° stairs, two of each of the forms 10, 12, and 14 are joined by bolting elements 28. Two of each of the corresponding bands 16, 18, and 20 are similarly bolted together at end elements 32. The free end elements 28 of forms 14 are attached to the pool wall with the bottom of the form resting flat against the floor of the pool. The outer surface of combined bands 20 is rested flat against the upper part of inner surface 30 of forms 14, and free end elements 32 of bands 20 is attached to the pool wall via bolts or screws.

Combined forms 12 are positioned inside the 180° arc defined by forms 14, with the bottom of forms 12 being equal in height with the top of forms 14. End elements 28 (the means for positioning form 12 above form 14) are attached to the wall of the pool, and combined bands 18 are installed as described above for bands 20. Leveling rods 22 are passed through the holes in upper flange 24 and lower flange 26 of forms 12 and rested against the bottom of the pool. Wedges 34, which can be made of wood, steel, or other material, are inserted between the lip of lower flanges 26 and leveling rods 22 to stabilize the rods.

Next, combined forms 10 are positioned inside the 180° arc defined by forms 12 and 14, with the bottom of forms 10 being positioned at the same height as the top of forms 12. End elements 28 (the means for positioning forms 10 above forms 12 and 14) and combined bands 16 are attached as described above, and leveling rods 22 inserted.

Referring to FIG. 4, bands 16, 18, and 20 (and the corresponding forms, which are not shown) define a 180° arc have radii $r_1$, $r_2$, $r_3$, of respectively 26, 36, and 46 inches.

Once the system is assembled, the pool stairs can be formed by pouring a suitable curing material. Generally, a cement containing mix such as a concrete mix, a sand-cement mix, or a a vermiculite-cement mix is used; a blacktop mix can also be used. The forms provide the stairs with their shape. Importantly, the forms and leveling rods can be removed a short time later (typically, in 5 minutes if the preferred vermiculite-concrete mix is used) because bands 16, 18, and 20 provide sufficient support for the partially cured mix. The bands also secure the stairs to the wall and stabilize the edge of the stairs.

Figure 5:
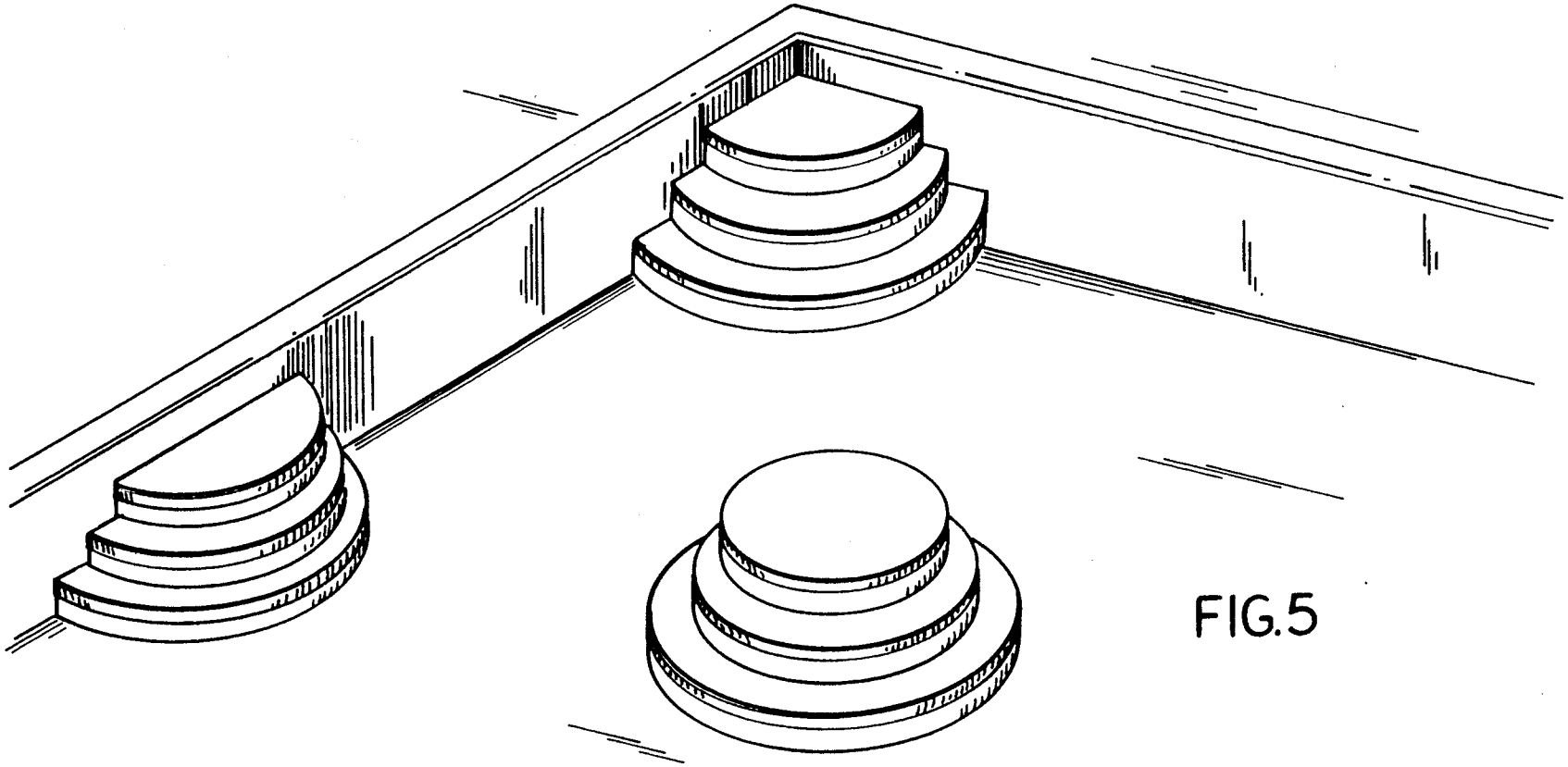
FIG. 5 is a perspective view of corner, wall, and circular stairs made using the forms of the invention.

After the forms are removed, the stairs may be foamed, the edges of the stairs capped, and a liner installed. Once the material has set the stairs are then ready for use. The finished wall stairs are shown in FIG. 5.

To construct 90° corner stairs, the same procedure described above is followed, except only one each of forms 10, 12, and 14 and bands 16, 18, and 20 are used. To construct a set of circular stairs, four of each of forms 10, 12, and 14 and the corresponding bands 16, 18, and 20 are attached to form a circle. The finished corner stairs and circular stairs are also shown in FIG. 5.

Other embodiments are within the following claims. For example, to form 135° corner stairs, one each of forms 10, 12, and 14 is attached to an additional corresponding form having half the length, respectively, of forms 10, 12, and 14. A corresponding set of bands is also used. Moreover, for flat wall stairs, a straight form portion can be inserted between two of the forms 10, 12 or 14, and when used with a corresponding band can form stairs with arcuate side portions and a straight central portion. One skilled in the art will understand that if a form is constructed in this shape the arcuate side portions of the form are considered arcuate forms within the meaning of this invention. Also, although in the preferred embodiment the arcuate support bands help fasten the stairs to the pool wall, bolts projecting from the pool wall or floor and into the form area into which the concrete will be poured can be used separately or in conjunction with the bands to serve the support function of holding the poured cement containing mix in position in relation to the pool wall.

I claim:

1. A method of constructing arcuate cement stairs in a pool having an inner wall, comprising (a) providing a first form member having a vertical stair-shaping surface defining an arc of a first form radius;

(b) providing a second form member having a vertical stair-shaping surface defining an arc of a second form radius smaller than said first form radius;

(c) attaching said first form member to said inner wall of said pool, providing a space between said stair-shaping surface of said first form radius and said inner wall of said pool;

(d) attaching said second form to said inner wall in a plane above said first form member, providing a space between said stair-shaping surface of said second form radius and said inner wall of said pool;

(e) attaching to said inner wall of said pool, inwardly of said first form member and positioned between a top and a bottom of said stair-shaping surface of said first form member, a first arcuate support band having a first band radius generally corresponding to said first form radius and having a vertical height less than a vertical height of said stair-shaping surface of said first form member;

(f) attaching to said inner wall of said pool, inwardly of said second form member and positioned between a top and a bottom of said stair-shaping surface of said first form member, a second arcuate support band having a second band radius generally corresponding to said second form radius and having a vertical height less than a vertical height of said stair-shaping surface of said second form member;

(g) pouring a curable cement containing material into said space between said stair-shaping surface of said first form member and said inner wall of said pool to form a first arcuate stair having a height corresponding to said height of said stair-shaping surface of said first form member and into said space between said stair-shaping surface of said second form member and said inner wall of said pool to form a second arcuate stair having a height corresponding to said height of said stair-shaping surface of said second form member; and (h) removing said first and second form members to provide said stairs constructed against said inner wall of said pool, said first and second bands remaining in place and supporting said stairs when said form members are removed.

2. The method of claim 1 wherein said stairs are constructed in a corner of said pool, and wherein said first and second arcuate form members and support bands define an arc of 90° C.

3. The method of claim 1 wherein said stairs are constructed on a straight wall of said pool, and wherein said first and second arcuate form members and support bands define an arc of 180°.

4. The method of claim 1, wherein said first arcuate support band is attached to said inner wall at said top of said stair-shaping surface of said first form member, and wherein said second arcuate support band is attached to said inner wall at said top of said stair-shaping surface of said second form member.

5. The method of claim 1, wherein said vertical height of said first arcuate band is less than half said height of said stair-shaping surface of said first form member; and wherein said vertical height of said second arcuate band is less than half said height of said stair-shaping surface of said second form member.

* * * * *